US010502209B2

(12) United States Patent
Nakai et al.

(10) Patent No.: US 10,502,209 B2
(45) Date of Patent: Dec. 10, 2019

(54) SCROLL COMPRESSOR AND AIR CONDITIONING APPARATUS INCLUDING THE SAME

(71) Applicant: DAIKIN INDUSTRIES, LTD., Osaka-shi, Osaka (JP)

(72) Inventors: Ryouta Nakai, Osaka (JP); Yasuhiro Murakami, Osaka (JP); Yasuo Mizushima, Osaka (JP); Masahiro Noro, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/072,366

(22) PCT Filed: Jan. 24, 2017

(86) PCT No.: PCT/JP2017/002364
§ 371 (c)(1),
(2) Date: Jul. 24, 2018

(87) PCT Pub. No.: WO2017/130971
PCT Pub. Date: Aug. 3, 2017

(65) Prior Publication Data

US 2019/0032659 A1 Jan. 31, 2019

(30) Foreign Application Priority Data

Jan. 26, 2016 (JP) ..... 2016-012037

(51) Int. Cl.
*F04C 18/02* (2006.01)
*F04C 29/02* (2006.01)
(Continued)

(52) U.S. Cl.
CPC ..... *F04C 18/0269* (2013.01); *F01C 1/0215* (2013.01); *F04C 18/02* (2013.01);
(Continued)

(58) Field of Classification Search
CPC ..... F04C 18/0269; F04C 18/0215; F04C 18/0246; F04C 18/02; F01C 1/0215
(Continued)

(56) References Cited

U.S. PATENT DOCUMENTS 4,773,835 A 9/1988 Machida et al.
5,320,505 A * 6/1994 Misiak ..... F04C 18/0246 418/55.1
(Continued)

FOREIGN PATENT DOCUMENTS

EP 0 769 623 A1 4/1997
JP 63-167090 A 7/1988
(Continued)

OTHER PUBLICATIONS

International Preliminary Report of corresponding PCT Application No. PCT/JP2017/002364 dated Aug. 9, 2018.
(Continued)

*Primary Examiner* — Dominick L Plakkoottam
(74) *Attorney, Agent, or Firm* — Global IP Counselors, LLP

(57) ABSTRACT

A scroll compressor includes a fixed scroll and a movable scroll. The fixed scroll has a spiral fixed-side wrap positioned upright on a surface of a fixed-side plate. The movable scroll is orbitably disposed to face the fixed scroll. The movable scroll has a spiral movable-side wrap positioned upright on a surface of a movable-side plate, with the movable-side wrap being configured to mesh with the fixed-side wrap. A side clearance is formed between a side surface of the fixed-side wrap and a side surface of the movable-side wrap so as to increase from an outer peripheral side toward an inner peripheral side of each of the wraps.

16 Claims, 9 Drawing Sheets

(51) Int. Cl.
*F04C 29/00* (2006.01)
*F01C 1/02* (2006.01)
*F04C 23/00* (2006.01)

(52) U.S. Cl.
CPC ..... *F04C 18/0215* (2013.01); *F04C 18/0246* (2013.01); *F04C 29/0028* (2013.01); *F04C 29/025* (2013.01); *F04C 29/028* (2013.01); *F04C 23/008* (2013.01); *F04C 2210/268* (2013.01); *F04C 2230/602* (2013.01); *F04C 2240/30* (2013.01)

(58) Field of Classification Search
USPC ..... 418/55.1–55.5; 417/410.5
See application file for complete search history.

(56) References Cited

U.S. PATENT DOCUMENTS 5,516,267 A * 5/1996 Ikeda ..... F01C 17/066 418/14
6,224,357 B1 * 5/2001 Komai ..... F01C 21/102 418/55.2
6,345,967 B1 * 2/2002 Mukai ..... F04C 18/0269 418/55.2
2003/0074905 A1 * 4/2003 Taira ..... B60H 1/3217 62/114
2012/0288394 A1 * 11/2012 Murakami ..... F04C 18/0269 418/55.1
2015/0322947 A1 * 11/2015 Takai ..... F04C 18/0215 418/55.2
2016/0003247 A1 1/2016 Matsumura et al.

FOREIGN PATENT DOCUMENTS

JP 2-16385 A 1/1990
JP 2009-174406 A 8/2009
WO 2014/155646 A1 10/2014

OTHER PUBLICATIONS

International Search Report of corresponding PCT Application No. PCT/JP2017/002364 dated Mar. 21, 2017.
European Search Report of corresponding EP Application No. 17 74 4201.9 dated Dec. 20, 2018.

* cited by examiner

SCROLL COMPRESSOR AND AIR CONDITIONING APPARATUS INCLUDING THE SAME

CROSS-REFERENCE TO RELATED APPLICATIONS

This U.S. National stage application claims priority under 35 U.S.C. § 119(a) to Japanese Patent Application No. 2016-0012037; filed in Japan on Jan. 26, 2016, the entire contents of which are hereby incorporated herein by reference.

TECHNICAL FIELD

The present invention relates to a scroll compressor and an air conditioning apparatus including the same.

BACKGROUND ART

Conventionally, as described in International Patent Publication No. WO2014/155646, there is a scroll compressor including a fixed scroll and a movable scroll which are provided with steps in order to reduce a leakage loss of a refrigerant that is caused by a clearance formed between a tooth tip of a wrap in one scroll and an opposed tooth bottom in the other scroll. Such steps are designed to become deeper at the tooth bottom of each scroll from its outer peripheral side toward its inner peripheral side,

SUMMARY

However, in the configuration that has the steps formed at the tooth bottoms of the scrolls, such as that described in International Patent Publication No. WO2014/155646, thermal expansion of the scrolls during an orbiting operation of the movable scroll is not sufficiently considered.

For example, in the case of using a refrigerant, such as difluoromethane (R32), in which the temperature of a discharge refrigerant gas tends to increase, a tooth thickness of the wrap in the scroll is more likely to increase due to its thermal expansion, and additionally an increase in the temperature of the wrap during a compression process becomes larger, under an operation condition at a high compression ratio. Thus, the tooth thickness of the wrap in the scroll due to the thermal expansion tends to increase drastically at a part near the inner periphery of the wrap than at a part near the outer periphery of the wrap. Regarding such deformation of the scroll due to the thermal expansion, if a side clearance between the side surface of the fixed-side wrap in the fixed scroll and the side surface of the movable-side wrap in the movable scroll is set with reference to the part near the outer periphery of each wrap, the side clearance becomes extremely small at a part near the inner periphery of the wrap, which might increase friction loss. Conversely, if the side clearance is set with reference to a part near the inner periphery of the wrap, the side clearance becomes extremely large at the part, near the outer periphery of each wrap, which might increase a leakage loss of the refrigerant. Even in the case of employing the configuration with the steps formed on the tooth bottoms of the scrolls, such as that described in International Patent Publication No. WO2014/155646, it is difficult to reduce the friction loss or leakage loss of the refrigerant due to such thermal expansion of the scroll.

Accordingly, it is an object of the present invention to employ a scroll structure in a scroll compressor arranged in consideration of the thermal expansion of scrolls during operation, so that a side clearance at a part near the inner periphery of a wrap is less likely to become extremely small, and that a side clearance at a part near the outer periphery of the wrap is less likely to become extremely large, thus resulting in reduced friction loss and leakage loss of the refrigerant.

A scroll compressor according to the first aspect includes a fixed scroll and a movable scroll. The fixed scroll has a spiral fixed-side wrap positioned upright on a surface of a fixed-side plate. The movable scroll is orbitably disposed to face the fixed scroll, and a spiral movable-side wrap that meshes with the fixed-side wrap is positioned upright on a surface of a movable-side plate. A side clearance is formed between a side surface of the fixed-side wrap and a side surface of the movable-side wrap so as to increase from an outer peripheral side toward an inner peripheral side of each wrap. Here, the term "side clearance" refers to a clearance formed between a side surface of the fixed-side wrap and a side surface of the movable-side wrap in a state where the side surface of the fixed-side wrap and the side surface of the movable-side wrap are located closest to each other.

If the thermal expansion of the scrolls during operation is not sufficiently considered, the increase in the tooth thickness of the wrap due to thermal expansion becomes larger at the part near the inner periphery of the wrap than at the part near the outer periphery of the wrap, and thereby the side clearance between the side surfaces of the fixed-side wrap and the movable-side wrap tends to be smaller at the part near the inner periphery of the wrap than at the part near the outer periphery of the wrap.

Here, in expectation of the tendency for the side clearance to become smaller at the part near the inner periphery of the wrap than at the part near the outer periphery of the wrap due to the thermal expansion during the operation, the side clearance is formed between the side surface of the fixed-side wrap and the side surface of the movable-side wrap so as to increase from the outer peripheral side toward the inner peripheral side as mentioned above.

This configuration can cancel the tendency for the side clearance to become smaller at the part near the inner periphery of the wrap than at the part near the outer periphery of the wrap due to the thermal expansion during the operation, so that the surface clearance at the part near the inner periphery of the wrap is less likely to become extremely small, and that the surface clearance at the part near the outer periphery of the wrap is less likely to become extremely large, thus making it possible to reduce the friction loss and leakage loss of the refrigerant.

A scroll compressor according to the second aspect is the scroll compressor according to the first aspect, wherein the increase in the side clearance is set such that the side clearance approaches a uniform state from the outer peripheral side to the inner peripheral side during an orbiting operation of the movable scroll.

Thus, this configuration can cancel the tendency for the side clearance to become smaller at the part near the inner periphery of the wrap than at the part near the outer periphery of the wrap until the side clearance becomes substantially uniform from the outer peripheral side to the inner peripheral side during the operation. Because of this, the surface clearance at the part near the inner periphery of the wrap is further less likely to become extremely small, and the surface clearance at the part near the outer periphery of the wrap is further less likely to become extremely large, thus making it possible to significantly reduce the friction loss and leakage loss of the refrigerant.

A scroll compressor according to the third aspect is the scroll compressor according to first or second aspect, wherein the increase in the side clearance is set such that an increase rate of the side clearance becomes larger from the outer peripheral side toward the inner peripheral side.

The temperature of the wrap during the compression process tends to increase drastically at the part near the inner periphery of the wrap than at the part near the outer periphery of the wrap, i.e., the temperature increase rate in the wrap tends to become larger from the outer peripheral side toward the inner peripheral side. Because of this, the side clearance due to the thermal expansion during the operation tends to contract drastically at the part near the inner periphery of the wrap than at the part near the outer periphery of the wrap. i.e., a contracted range of the wrap becomes larger from the outer peripheral side toward the inner peripheral side.

Here, in consideration of the tendency for a contracted range of the side clearance to increase from the outer peripheral side to the inner peripheral side due to the thermal expansion during the operation, the increase in the side clearance for cancelling the tendency is set in advance such that an increase rate of the side clearance becomes larger from the outer peripheral side to the inner peripheral side, as mentioned above.

Thus, the side clearance can be appropriately set according to the tendency of the temperature increase during the compression process, so that the side clearance at the part near the inner periphery of the wrap is further less likely to become extremely small, and that the side clearance at the part near the outer periphery of the wrap is further less likely to become extremely large, thus making it possible to significantly reduce the friction loss and leakage loss of the refrigerant.

A scroll compressor according to the fourth aspect is the scroll compressor according to any one of the first to third aspects, wherein the increase in the side clearance is obtained by decreasing a tooth thickness of the fixed-side wrap and/or the movable-side wrap from the outer peripheral side toward the inner peripheral side.

Here, by decreasing the tooth thickness of the wrap from the outer peripheral side toward the inner peripheral side, the desired increase in the side clearance can be easily obtained.

A scroll compressor according to the fifth aspect is used to compress a refrigerant containing R32.

In the case of using the refrigerant, mentioned above, in which the temperature of a discharge refrigerant gas tends to increase, a tooth thickness of the wrap in the scroll is more likely to increase due to its thermal expansion, and further an increase in the temperature of the wrap during a compression process also becomes larger. Thus, the tooth thickness of the wrap in the scroll due to the thermal expansion tends to increase remarkably at the part near the inner periphery of the wrap than at the part near the outer periphery of the wrap.

As for this fact, employing the scroll compressor according to any one of the first to fourth aspects can cancel the tendency for the side clearance to become smaller at the part near the inner periphery of the wrap than at the part near the outer periphery of the wrap due to the thermal expansion during the operation. Consequently, the surface clearance at the part near the inner periphery of the wrap is less likely to become extremely small, and the surface clearance at the part near the outer periphery of the wrap is less likely to become extremely large during the operation.

An air conditioning apparatus according to the sixth aspect includes the scroll compressor according to any one of the first to fifth aspects.

Here, the friction loss and leakage loss of the refrigerant in the scroll compressor can be reduced, which also contributes to improvement of an air conditioning capability of the air conditioning apparatus.

DESCRIPTION OF EMBODIMENTS

Hereinafter, embodiments of a scroll compressor according to the present invention will be described with reference to the accompanying drawings. It is noted that the specific configurations of the embodiments of the scroll compressor according to the present invention are not limited to the following embodiments and modified examples, and can be changed without departing from the gist of the present invention.

(1) Basic Configuration and Operation

Figure 1:
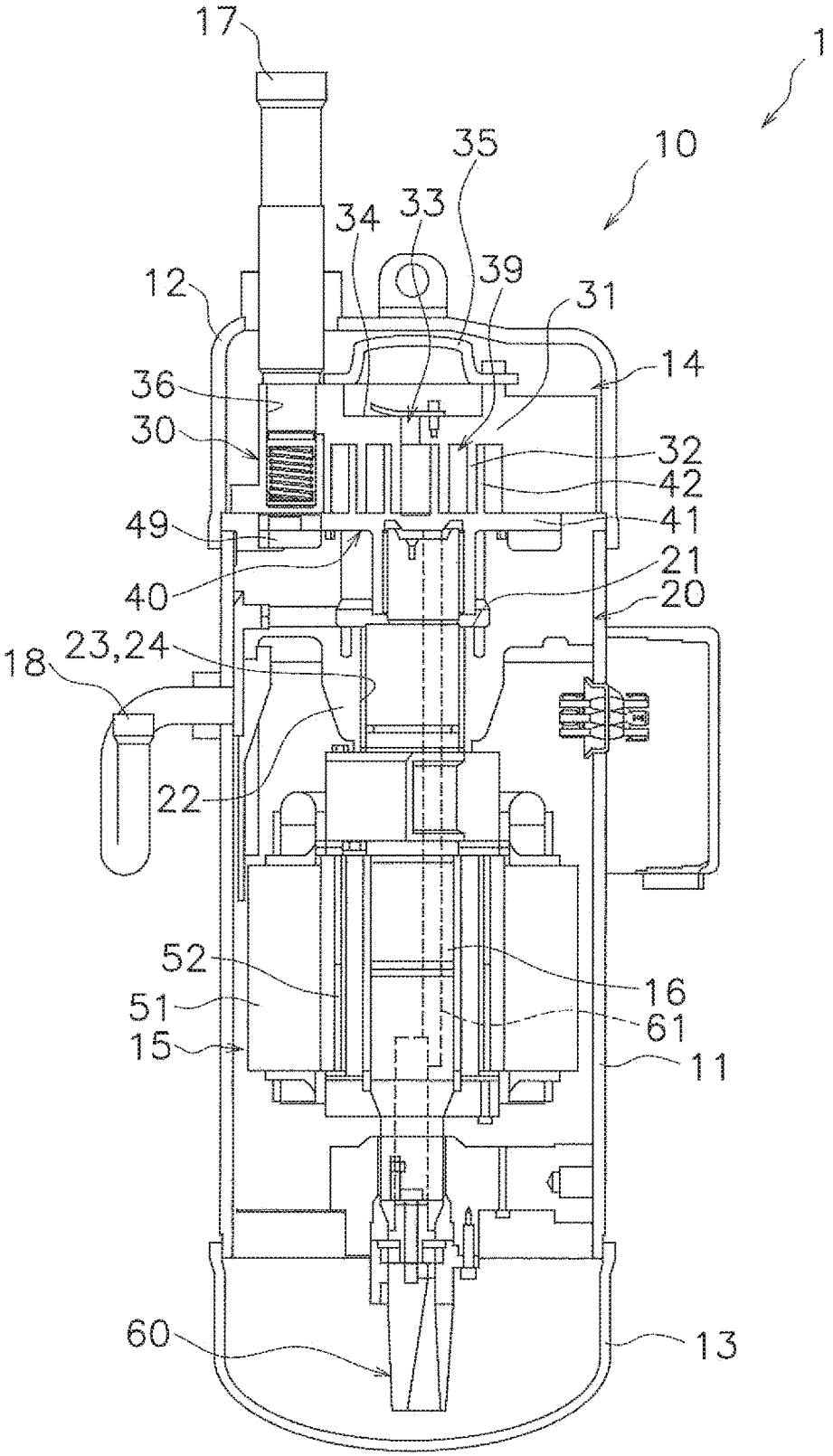
FIG. 1 is a schematic cross-sectional view of a scroll compressor according to an embodiment of the present invention.

FIG. 1 is a schematic cross-sectional view of a scroll compressor 1 according to an embodiment of the present invention.

The scroll compressor 1 includes a sealed dome-shaped casing 10 having an elongated cylindrical shape. The casing 10 is a pressure vessel configured by a casing main body 11, a top wall portion 12, and a bottom wall portion 13, and further the inside of the casing 10 is hollow. The casing main body 11 is a cylindrical body that has an axis extending in the up-down direction. The upper wall portion 12 is integrally joined to an upper end of the casing main body 11 by airtight welding, and is a howl-shaped portion that has a convex surface protruding upward. The bottom wall portion 13 is integrally joined to a lower end of the casing main body 11 by airtight welding, and is a howl-shaped portion that has a convex surface protruding downward.

A compression mechanism 14 for compressing the refrigerant and a motor 15 disposed below the compression mechanism 14 are accommodated inside the casing 10. The compression mechanism 14 and the motor 15 are coupled together by a drive shaft 16 disposed to extend within the casing 10 in the up-down direction.

The compression mechanism 14 includes a housing 20, a fixed scroll 30 disposed in intimate contact with an upper part of the housing 20, and a movable scroll 40 meshing with the fixed scroll 30. The housing 20 has its entire outer peripheral surface in the circumferential direction press-fitted and fixed to the casing main body 11. That is, the casing main body 11 and the housing 20 are airtightly in intimate contact with each other over the entire circumferences of them. The inside of the casing 10 is a high-pressure space filled with a high-pressure refrigerant after being compressed by the compression mechanism 14, whereby the scroll compressor 1 is a so-called high-pressure dome-type compressor. The housing 20 has a housing concave portion 21 formed to be recessed at the center of an upper surface thereof, and also has a bearing portion 22 formed to extend downward from the center of a lower surface thereof. Further, the housing 20 has a bearing hole 23 that penetrates the lower end surface of the hearing portion 22 and the bottom surface of the housing concave portion 21. The drive shaft 16 is rotatably fitted into the bearing hole 23 via a bearing 24.

A suction pipe 17 is airtightly fitted into the upper wall portion 12 of the casing 10. The suction pipe 17 allows the low-pressure refrigerant to flow from the outside of the casing 10 into the casing 10 and guides the refrigerant to the compression mechanism 14. A discharge pipe 18 is airtightly fitted in the casing main body 11 so as to discharge the high-pressure refrigerant in the casing 10 to the outside of the casing 10. The suction pipe 17 penetrates the top wall portion 12 of the casing 10 in the up-down direction, and has the inner end thereof fitted into the fixed scroll 30 in the compression mechanism 14. The discharge pipe 18 penetrates the casing main body 11 of the casing 10 in the lateral direction, and has the inner end thereof communicating with a high-pressure space in the casing 10. The lower end surface of the fixed scroll 30 is in intimate contact with the upper end surface of the housing 20. The fixed scroll 30 is fixed to the housing 20 by bolts or the like.

The fixed scroll 30 mainly includes a fixed-side plate 31 and a fixed-side wrap 32. The fixed-side wrap 32 is a spiral (involute-shaped) portion positioned upright on a surface (here, the lower surface) of the fixed-side plate 31. The movable scroll 40 mainly includes a movable-side plate 41 and a movable-side wrap 42. The movable-side wrap 42 is a spiral (involute-shaped) portion that meshes with the fixed-side wrap 32 positioned upright on a surface (here, the upper surface) of the movable-side plate 41. The movable scroll 40 is supported by the housing 20 via an oldham ring 49, and the upper end of the drive shaft 16 is fitted into the movable scroll 40, so that the movable scroll 40 can revolve within the housing 20 without rotating itself by the rotation of the drive shaft 16. The other surface (here, lower surface) of the movable-side plate 41 in the movable scroll 40 is pressed against the fixed scroll 30 by a high-pressure refrigerant filling the space between the movable-side plate 41 and the housing concave portion 21. The fixed-side wrap 32 of the fixed scroll 30 and the movable-side wrap 42 of the movable scroll 40 mesh with each other to form a compression chamber 39 between the fixed scroll 30 and the movable scroll 40. The compression chamber 39 is configured to compress the refrigerant by contracting the volume thereof formed between both the wraps 32 and 42 toward the center of the compression chamber along with the orbiting of the movable scroll 40. Here, the fixed-side wrap 32 and the movable-side wrap 42 have asymmetric scroll shapes formed to be shifted in phase by 180 degrees with respect to the rotation of the drive shaft 16. However, the shape of the scrolls is not limited to the asymmetric scroll shape, and may be a symmetric scroll shape.

In the fixed-side plate 31 of the fixed scroll 30, a discharge port 33 is formed to communicate with the compression chamber 39, and an enlarged concave portion 34 is also formed to continue to the discharge port 33. The discharge port 33 is a port for discharging the refrigerant after being compressed in the compression chamber 39, and is formed to extend in the up-down direction at the center of the fixed-side plate 31. The enlarged concave portion 34 is configured by a concave portion which is formed by recessing the upper surface of the fixed-side plate 31 and expands in the horizontal direction. A chamber cover 35 is fixed to the upper surface of the fixed scroll 30 by bolts or the like so as to close the enlarged concave portion 34. The enlarged concave portion 34 is covered with the chamber cover 35 to form a chamber room which is positioned above the discharge port 33 and into which the refrigerant flows from the compression chamber 39 through the discharge port 33. In the fixed scroll 30, a suction port 36 is formed to cause the upper surface of the fixed scroll 30 to communicate with the compression chamber 39 and to fit the suction pipe 17 thereinto. The fixed scroll 30 and the housing 20 have a communication flow path (not shown) formed therein to allow the refrigerant in the chamber to flow out to the high-pressure space.

The motor 15 includes an annular stator 51 fixed to a wall surface in the casing 10, and a rotor 52 rotatably configured on an inner peripheral side of the stator 51. The stator 51 has a winding attached thereon. The rotor 52 is drivingly coupled to the movable scroll 40 of the compression mechanism 14 via a drive shaft 16 disposed at the axial center of the casing main body 11 so as to extend in the up-down direction.

A pump 60 is disposed in a lower space located below the motor 15, while storing lubricating oil at the bottom of the lower space. The pump 60 is fixed to the casing main body 11 and attached to the lower end of the drive shaft 16, and thereby is configured to pump up the stored lubricating oil. An oil supply passage 61 is formed in the drive shaft 16, so that the lubricating oil pumped up by the pump 60 is supplied to each sliding portion through the oil supply passage 61.

In the scroll compressor 1 having the basic configuration described above, once the motor 15 is energized and driven, the rotor 52 rotates with respect to the stator 51, thereby rotating the drive shaft 16. When the drive shaft 16 rotates, the movable scroll 40 operates to orbit around the fixed scroll 30. Thus, the low-pressure refrigerant is drawn into the compression chamber 39 from a part near the outer periphery of the compression chamber 39 through the suction pipe 17. The refrigerant drawn into the compression chamber 39 is compressed while being sent to a part near the inner periphery of the compression chamber 39 with a change in the volume of the compression chamber 39. Then, the high-pressure refrigerant compressed in the compression chamber 39 is sent from the discharge port 33 located at the center of the compression chamber 39 to a high-pressure space in the casing 10 through the chamber room and the communication flow path, and then discharged to the outside of the casing 10 through the discharge pipe 18.

During such an orbiting operation of the movable scroll 40, thermal expansion of the scrolls 30 and 40 occurs. For example, in the case of using a refrigerant, such as R32, in which the temperature of the discharge refrigerant gas tends to increase, the tooth thicknesses tr and ts of the wraps 32 and 42 of the scrolls 30 and 40 (see FIGS. 2 and 3) are more likely to increase due to thermal expansion under an operating condition having a high compression ratio. In addition, an increase in the temperature of the wrap during a compression process also becomes larger. Thus, as show in FIGS. 2 and 3, the tooth thicknesses tr and ts of the wraps 32 and 42 of the scrolls 30 and 40 due to the thermal expansion tends to increase drastically at the parts near the inner peripheries of the wraps 32 and 42 (i.e., winding start parts of the wrap 32 and 42) than at the parts near the outer peripheries of the wraps 32 and 42 (i.e., winding end parts of the wraps 32 and 42). For this reason, in the movable scroll 40, an inner peripheral side surface 45 of the movable-side wrap 42 projects toward the inner peripheral side, and an outer peripheral side surface 44 of the movable-side wrap 42 projects toward the outer peripheral side due to thermal expansion of the movable-side wrap 42 during operation (see the side surfaces 44 and 45 of the movable-side wrap 42 shown by the solid line and the broken line in FIG. 2). In the fixed scroll 30, an inner peripheral side surface 35 of the fixed-side wrap 32 projects toward the inner peripheral side, and an outer peripheral side surface 34 of the fixed-side wrap 32 projects toward the outer peripheral side due to thermal expansion of the fixed-side wrap 32 during the operation (see the side surfaces 34 and 35 of the fixed-side wrap 32 shown by the solid line and the broken line in FIG. 3).

Figure 4:
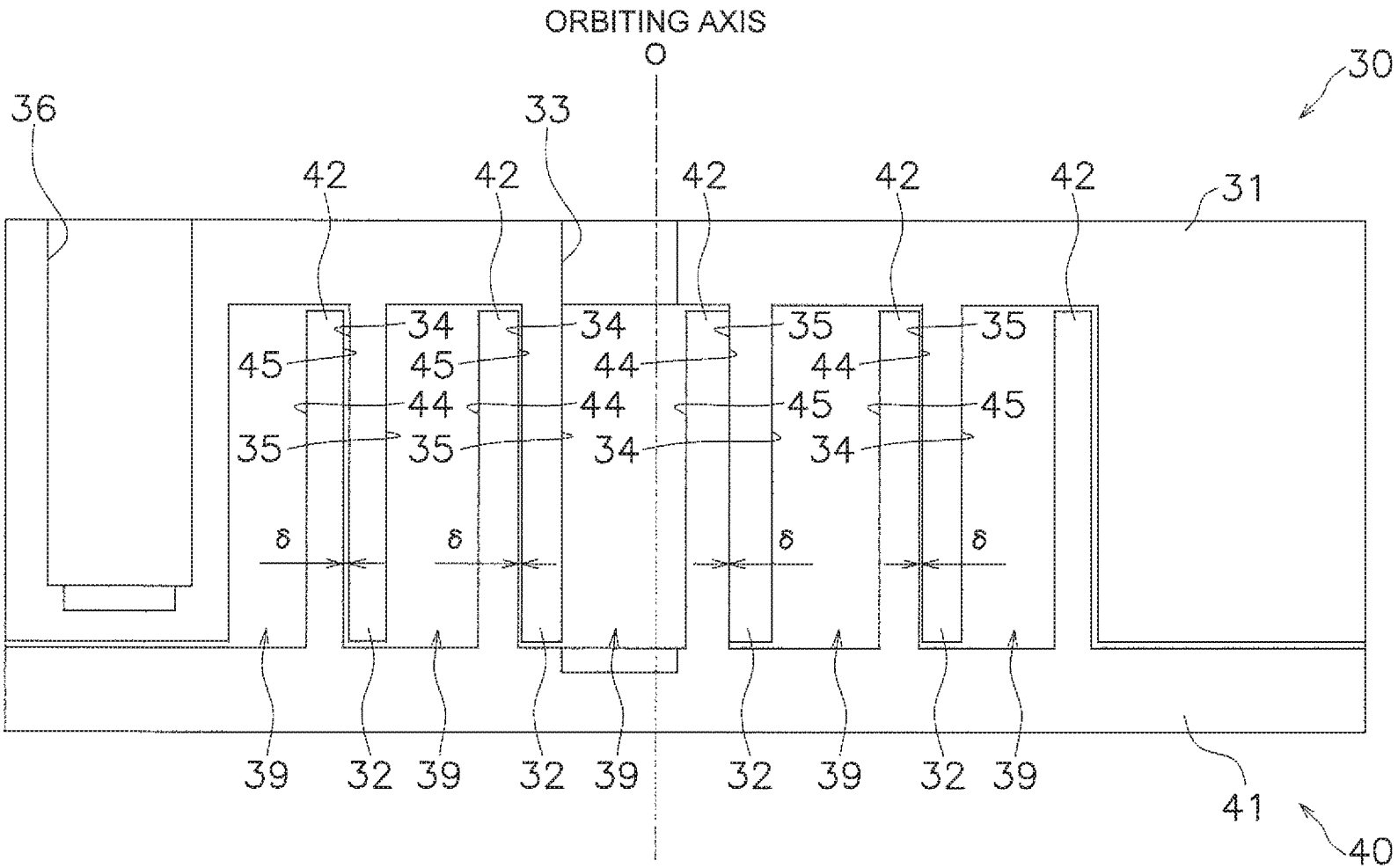
FIG. 4 is a diagram showing a state in which a side clearance becomes excessively small at a part near the inner periphery of the wrap due to thermal expansion during operation in a case where a scroll structure according to the present invention is not employed.

Regarding such deformation of the scrolls 30 and 40 due to the thermal expansion during the operation, it can be assumed that a side clearance δ between the side surface 34, 35 of the fixed-side wrap 32 in the fixed scroll 30 and the side surface 44, 45 of the movable-side wrap 42 in the movable scroll 40 is set with reference to the part near the outer periphery of the wrap 32, 42. Here, the term side clearance δ refers to a clearance formed between both the side surfaces 35 and 44 in a state in which the inner peripheral side surface 35 of the fixed-side wrap 32 and the outer peripheral side surface 44 of the movable-side wrap 42 are located closest to each other, or a clearance formed between both side surfaces 34 and 45 in a state in which the outer peripheral side surface 34 of the fixed-side wrap 32 and the inner peripheral side surface 45 of the movable-side wrap 42 are located closest to each other. When the side clearance δ is set as described above, as shown in FIG. 4, a side clearance δ becomes appropriate in the parts near the outer peripheries of the wraps 32 and 42 (the parts located the farthest from an orbiting axis O of the movable scroll 40 in FIG. 4). However, the side clearance δ becomes smaller toward the inner periphery to be eventually extremely, small in parts near the inner peripheries of the wraps 32 and 42 (the parts located closest to the orbiting axis O of the movable scroll 40 in FIG. 4), which could increase the friction loss.

Figure 5:
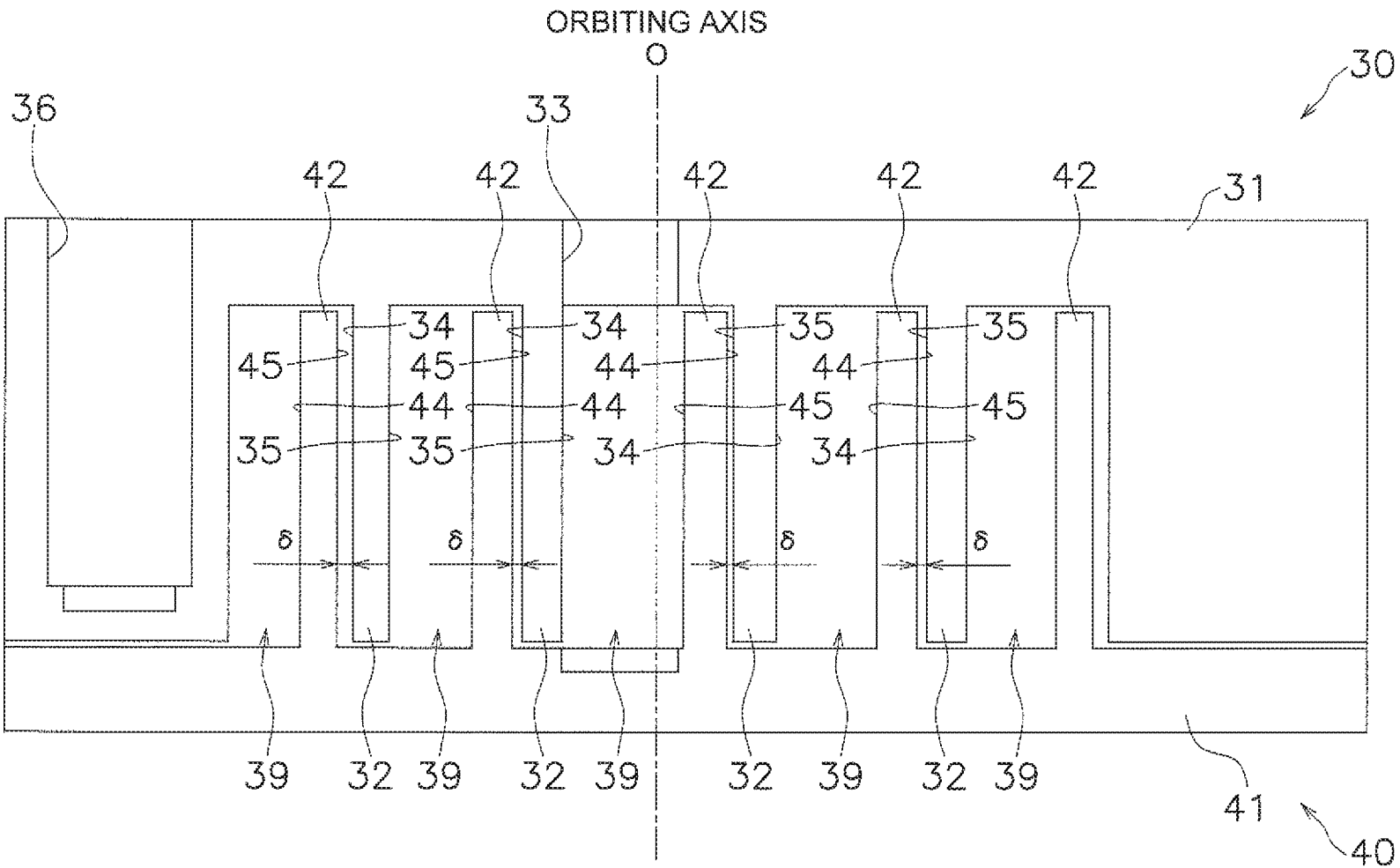
FIG. 5 is a diagram showing a state in which a side clearance becomes extremely large at a part near the outer periphery of the wrap due to thermal expansion during operation in a case where the scroll structure according to the present invention is not employed.

Conversely, regarding such deformation of the scrolls 30 and 40 due to the thermal expansion during operation, it can be assumed that the side clearance δ is set with reference to the part near the inner periphery of the wraps 32 and 42. When the side clearance δ is set in this way, as shown in FIG. 5, a side clearance δ becomes appropriate in the parts near the outer peripheries of the wraps 32 and 42 (the parts located closest to the orbiting axis O of the movable scroll 40 in FIG. 5). However, the side clearance δ becomes larger toward the outer periphery to be eventually extremely large in parts near the outer peripheries of the wraps 30 and 40 (the parts located the farthest from the orbiting axis O of the movable scroll 40 in FIG. 5), which could increase the leakage loss of the refrigerant.

Figure 2:
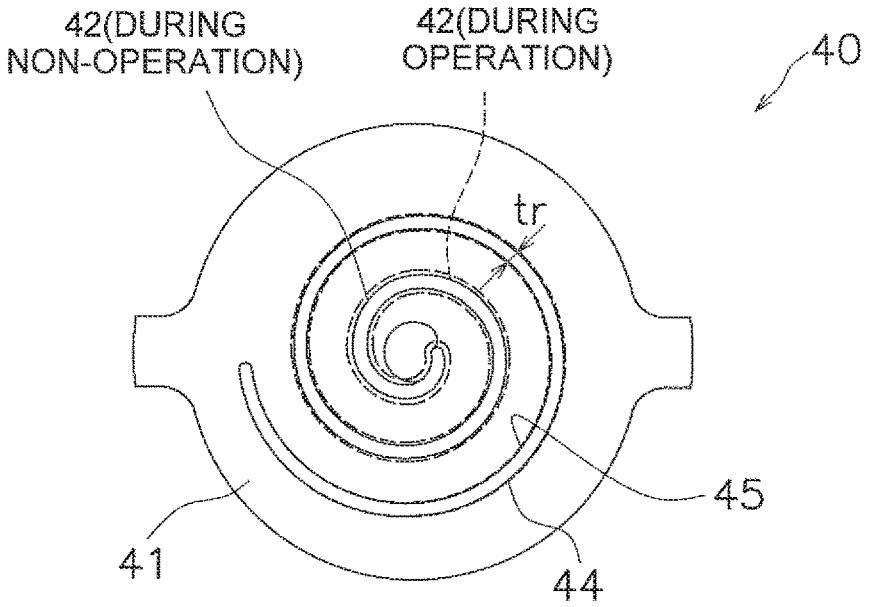
FIG. 2 is a diagram showing a state in which the tooth thickness of a movable scroll increases due to thermal expansion during operation.
Figure 3:
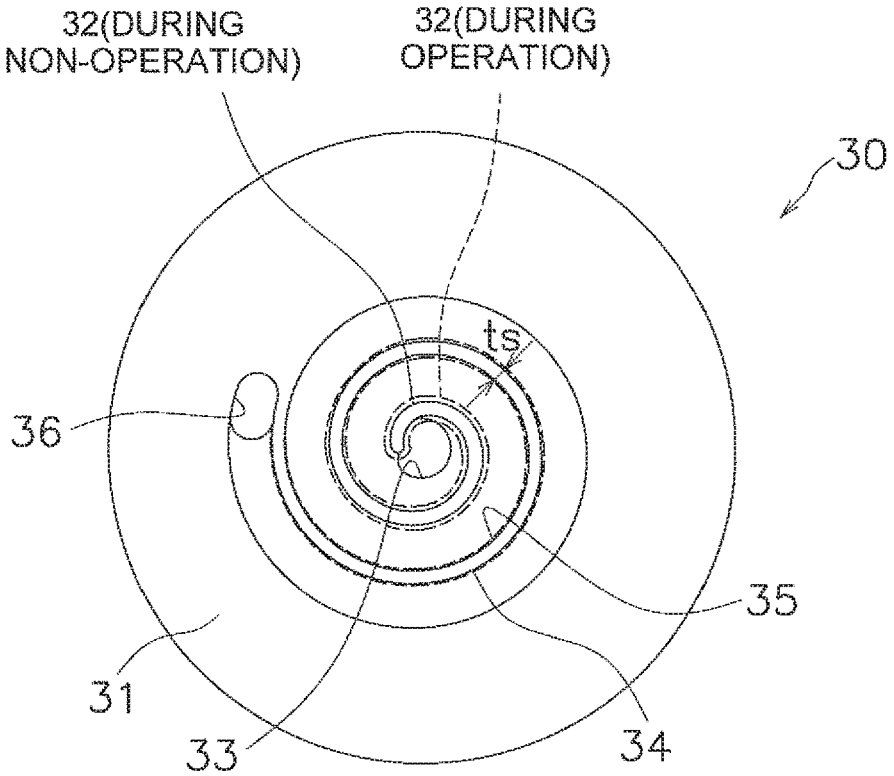
FIG. 3 is a diagram showing a state in which the tooth thickness of a fixed scroll increases due to thermal expansion during operation.

In this way, during the orbiting operation of the movable scroll 40, as shown in FIGS. 2 and 3, the friction loss or leakage loss of the refrigerant could increase due to a change in the side clearance δ between the wraps 30 and 40 that is caused by thermal expansion of the scrolls 30 and 40. Note that, in FIGS. 2 to 5, for convenience of description, a deformation amount of the wrap due to the thermal expansion is shown to be considerably larger than an actual deformation amount.

In contrast, the scroll compressor 1 employs the scroll structure arranged in consideration of the thermal expansion of the scrolls 30 and 40 during operation, as will be described below.

(2) Detailed Structure of Scroll and its Characteristics

Figure 6:
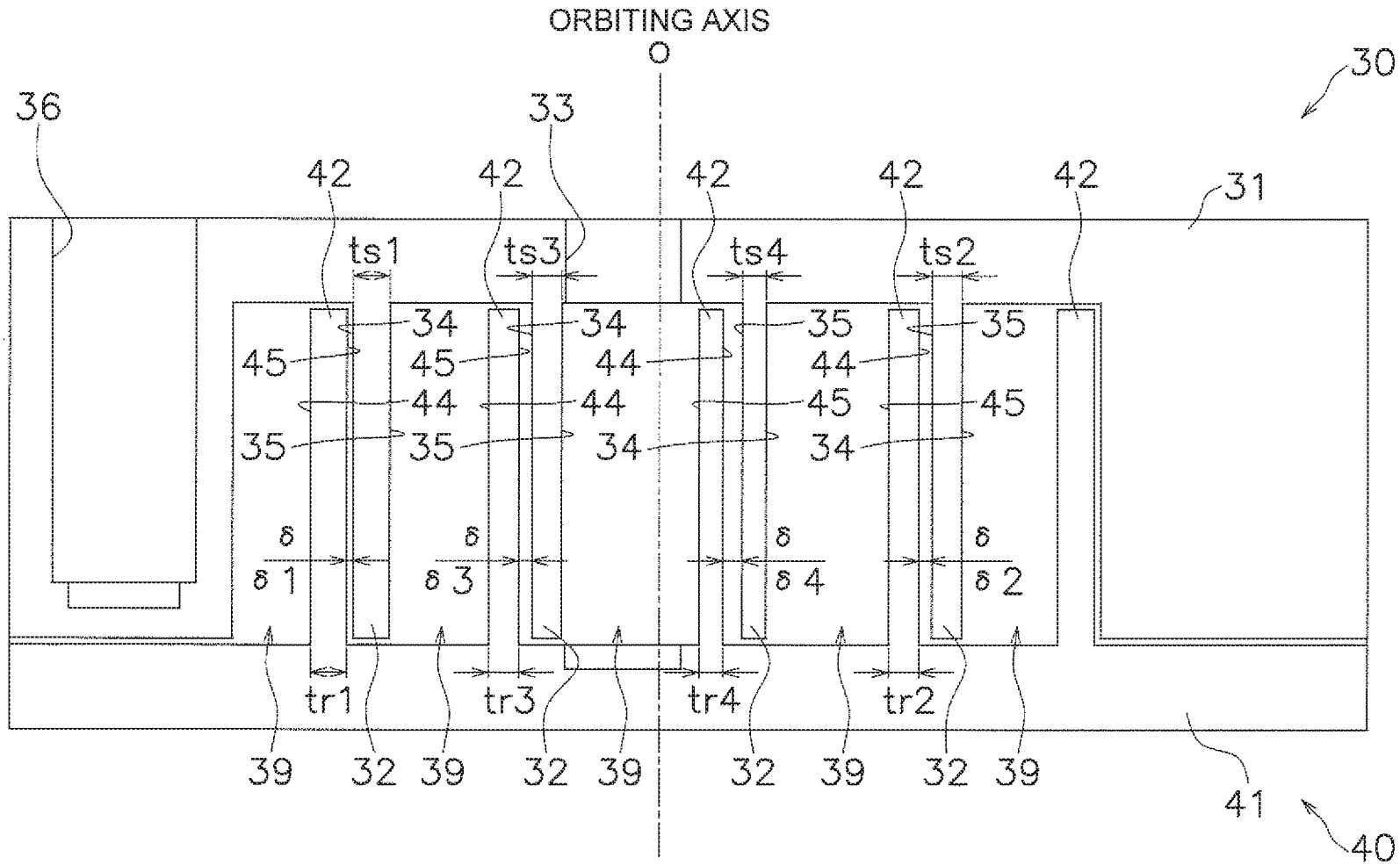
FIG. 6 is a diagram showing a scroll structure according to the present invention.
Figure 7:
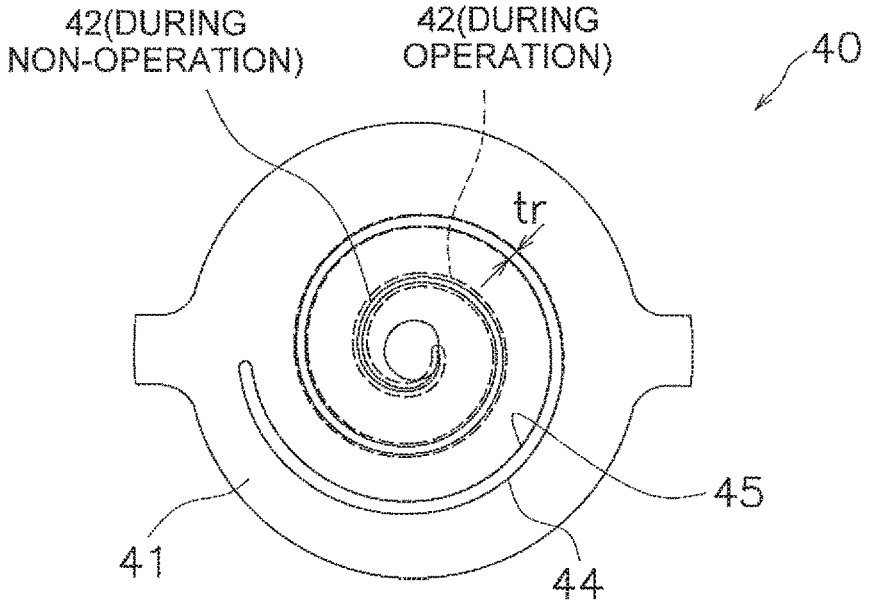
FIG. 7 is a diagram showing a movable scroll according to the present invention.
Figure 8:
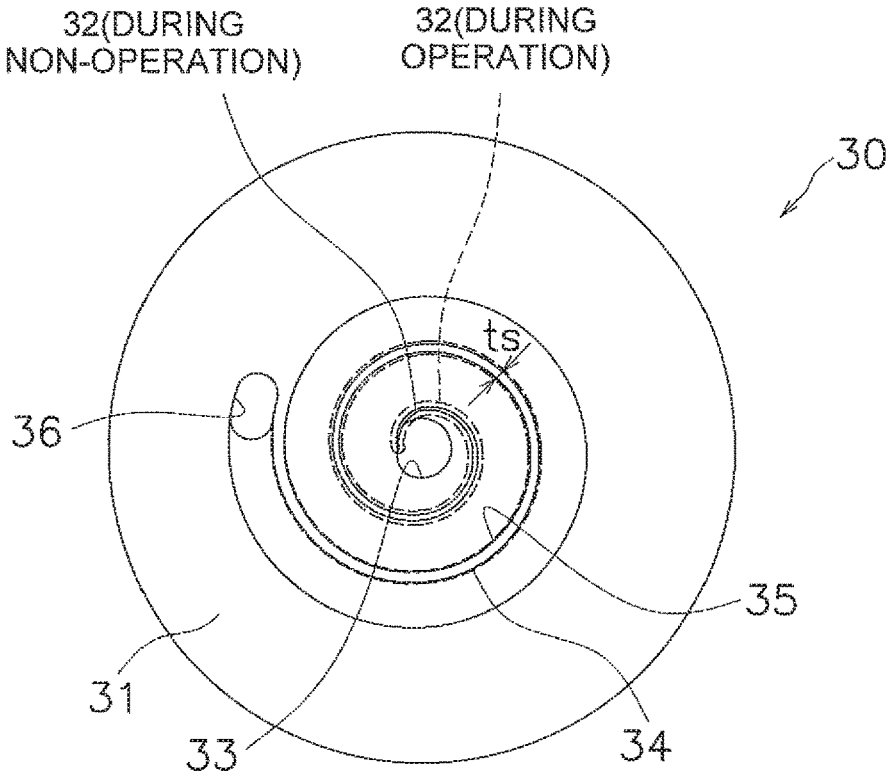
FIG. 8 is a diagram showing a fixed scroll according to the present invention.
Figure 9:
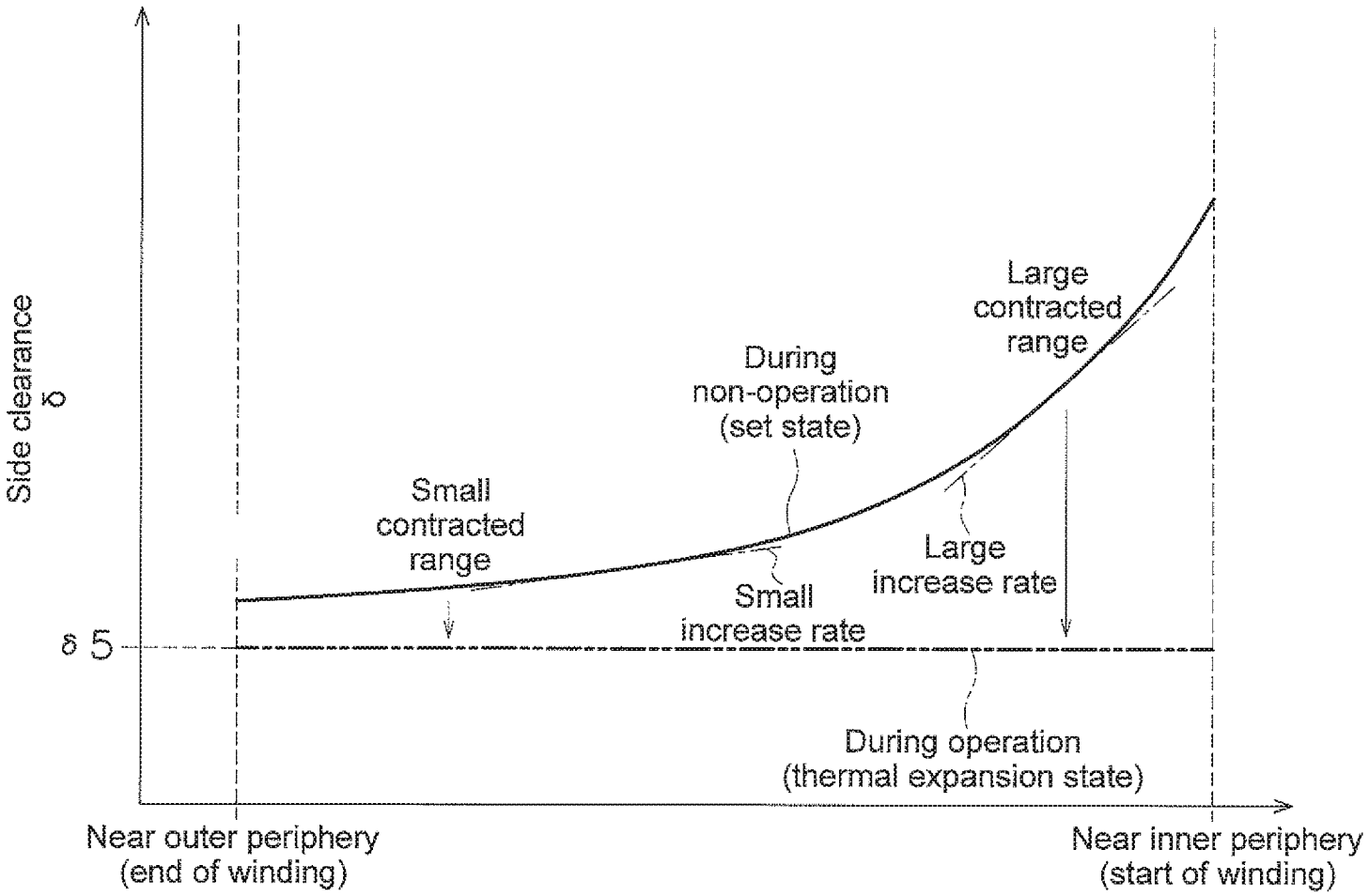
FIG. 9 is a diagram showing values of the side clearance in the scroll structure according to the present invention.
Figure 10:
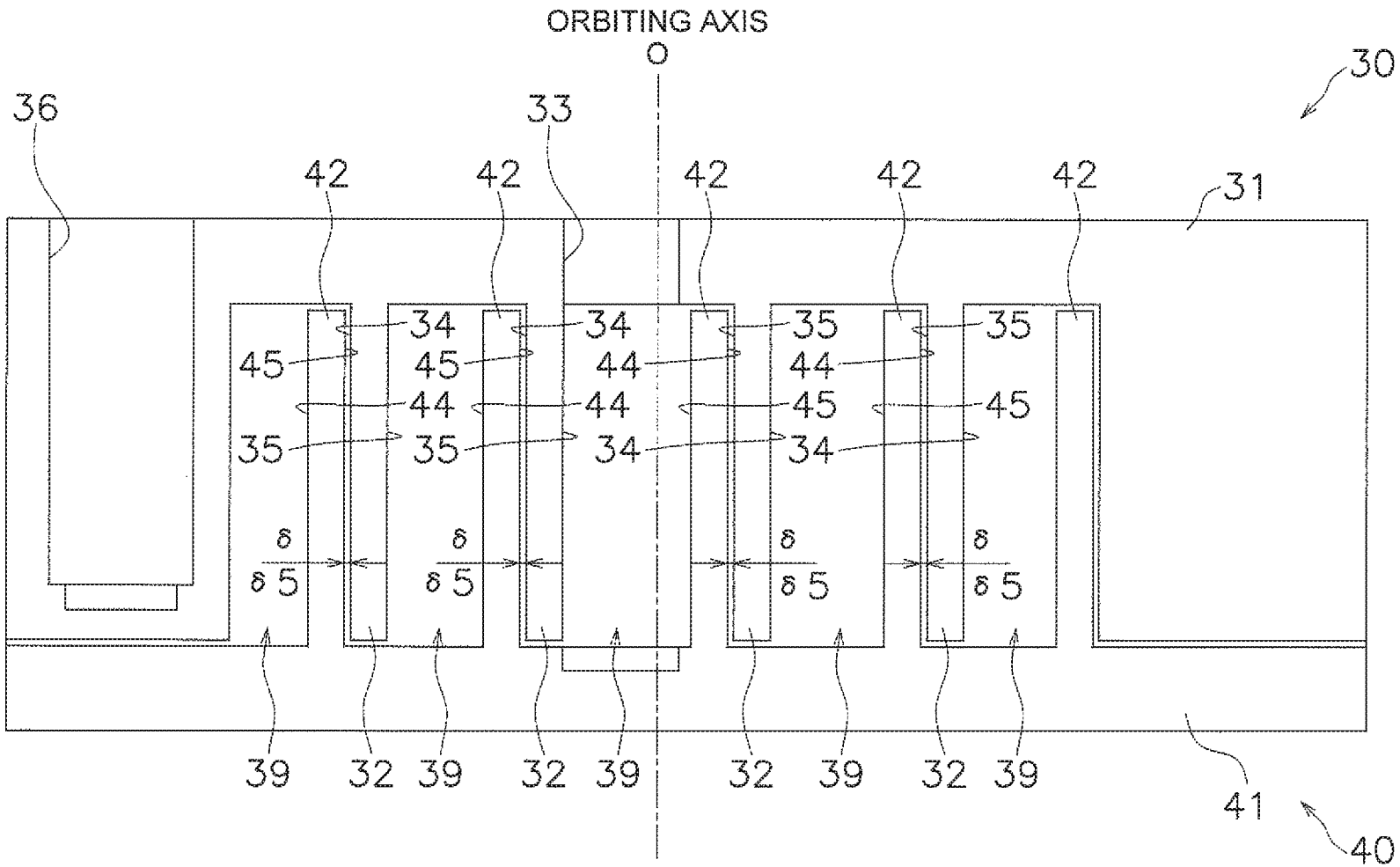
FIG. 10 is a diagram showing a changed state of the side clearance due to thermal expansion during operation in a case where the scroll structure according to the present invention is employed.

Next, the detailed structures of the scrolls 30 and 40 arranged in consideration of the thermal expansion during operation will be described with reference to FIGS. 2 to 10. Here, FIG. 6 is a diagram showing the scroll structure according to the present invention. FIG. 7 is a diagram showing the movable scroll 40 according to the present invention. FIG. 8 is a diagram showing the fixed scroll 30 according to the present invention. FIG. 9 is a diagram showing values of the side clearance δ in the scroll structure according to the present invention. FIG. 10 is a diagram showing a changed state of the side clearance δ due to the thermal expansion during operation in the case of employing the scroll structure according to the present invention.

As mentioned above, if the thermal expansion of the scrolls 30 and 40 during operation is not sufficiently considered, the increase in the tooth thickness of each of the wraps 32 and 42 due to the thermal expansion becomes larger at the parts near the inner peripheries of the wraps 32 and 42 than that at the parts near the outer peripheries of the wraps 32 and 42 (see the side surfaces 34, 35, 44, and 45 of the wraps 32 and 42 as indicated by the broken lines in FIGS. 2 and 3). Consequently, the side clearance δ between the side surface 34, 35 of the fixed-side wrap 32 and the side surface 44, 45 of the movable-side wrap 42 tends to be smaller at the parts near the inner peripheries of the wraps 32 and 42 (i.e., winding start parts of the wraps 32 and 42) than that at the parts near the outer peripheries of the wraps 32 and 42 (i.e., winding end parts of the wrap 32, 42 (see FIGS. 4 and 5).

Here, as shown in FIG. 6, in expectation of the tendency for the side clearance δ to become smaller at the part near the inner periphery of each of the wraps 32 and 42 than at the part near the outer periphery of the wrap due to the thermal expansion during operation, the side clearance δ is formed between the side surface 34, 35 of the fixed-side wrap 32 and the side surface 44, 45 of the movable-side wrap 42 so as to increase from the outer peripheral side toward the inner peripheral side. Here, when the side clearances δ shown in FIG. 6 are denoted as δ1, δ2, δ3, and δ4 in this order from the parts near the outer peripheries of the wraps 32 and 42 to the parts near the inner peripheries thereof the magnitude relationship among them are as follows: $\delta 1<\delta 2<\delta 3<\delta 4$. FIG. 6 shows the shape of the scrolls in a state where the orbiting operation of the movable scroll 40 is not performed, that is, in a state where the thermal expansion of the scrolls 30 and 40 does not occur during the operation.

As shown in FIG. 10, this configuration can cancel the tendency for the side clearance δ to become smaller at the parts near the inner peripheries of the wraps 32 and 42 than that at the parts near the outer peripheries of the wraps 32 and 42 due to the thermal expansion during the operation, so that the side clearance δ at the part near the inner periphery of each of the wraps 32 and 42 is less likely to become extremely small, and that the side clearance δ at the part near the outer periphery of the wraps 32 and 42 is less likely to become extremely large during the operation, thus making it possible to reduce the friction loss and leakage loss of the refrigerant.

Here, particularly, as shown in FIGS. 9 and 10, an increase in the side clearance δ is set such that the side clearance δ approaches a uniform state from the outer peripheral side to the inner peripheral side during the orbiting operation of the movable scroll 40 (during operation). The term "uniform state" as used herein means that the side clearance δ formed when an operation of the orbiting the movable scroll 40 (during a non-operation) is not performed (see the side clearance δ indicated by the solid line in FIG. 9 and the side clearances δ1 to δ4 in FIG. 6) approaches a constant level from the outer peripheral side to the inner peripheral side during the operation, as shown by the side clearance δ formed during operation (see the side clearance 65 indicated by an alternate long and two short dashes line in FIG. 9 and the side clearance 65 indicated in FIG. 10).

Thus, this configuration can cancel the tendency for the side clearance δ to become smaller at the parts near the inner peripheries of the wraps 32 and 42 than that at the parts near the outer peripheries of the wraps 32 and 42 until the side clearance δ becomes substantially uniform from the outer peripheral side to the inner peripheral side during the operation. Because of this, the side clearance δ at the parts near the inner peripheries of the wraps 32 and 42 is less likely to become extremely small, and the side clearance δ at the parts near the outer peripheries of the wraps 32 and 42 is less likely to become extremely large, thus making it possible to significantly reduce the friction loss and leakage loss of the refrigerant.

Furthermore, the temperature of the wraps 32 and 42 during the compression process tends to drastically increase at the parts near the inner peripheries of theses wraps than at the parts near the outer peripheries of the wraps, i.e., the temperature increase rate becomes larger from the outer peripheral side to the inner peripheral side. Because of this, the contraction of the side clearance δ due to the thermal expansion during the operation tends to become much more remarkable at the part near the inner periphery of the wraps 32 and 42 than at the part near the outer periphery of the wrap, i.e., a contracted range of the wrap becomes larger from the outer peripheral side to the inner peripheral side.

For this reason, in consideration of the tendency for the contracted range of the side clearance δ to increase from the outer peripheral side to the inner peripheral side due to the thermal expansion during the operation, an increase in the side clearance δ is set so as to cancel this tendency, specifically, such that an increase rate of the side clearance becomes larger from the outer peripheral side to the inner peripheral side (see the side clearance δ indicated by the solid line in FIG. 9 and the side clearances δ1 to δ4 indicated by the solid line in FIG. 6). For example, the side clearance δ is increased exponentially from the parts near the outer peripheries of the wraps 32 and 42 to the parts near the inner peripheries thereof (see the side clearance δ indicated by the solid line in FIG. 9).

Thus, the side clearance δ can be appropriately set according to the tendency of the temperature increase during the compression process, so that the surface clearance δ at the part near the inner periphery of each of the wraps 32 and 42 is less likely to become extremely small, and that the surface clearance δ at the part near the outer periphery of each of the wraps 32 and 42 is less likely to become extremely large, thus making it possible to significantly reduce the friction loss and leakage loss of the refrigerant.

Here, such an increase in the side clearance δ, mentioned above, can be obtained by decreasing the tooth thicknesses ts and tr of the fixed-side wrap 32 and the movable-side wrap 42 from the outer peripheral side to the inner peripheral side as shown in FIGS. 6 to 8. For example, as shown in FIG. 6, the tooth thickness ts of the fixed-side wrap 32 is decreased in the order of ts1, ts2, ts3, and ts4 from the part near the outer periphery of the wrap 32 to the part near the inner periphery thereof, and concurrently, the tooth thickness tr of the movable-side wrap 42 is made smaller in the order of tr1, tr2, tr3, and tr4 from the part near the outer periphery of the wrap 42 to the part near the inner periphery thereof.

Thus, by decreasing the tooth thicknesses ts and tr of the wraps 32 and 42 from the outer peripheral side to the inner peripheral side, a desired increase in the side clearance δ can be easily obtained.

Figure 11:
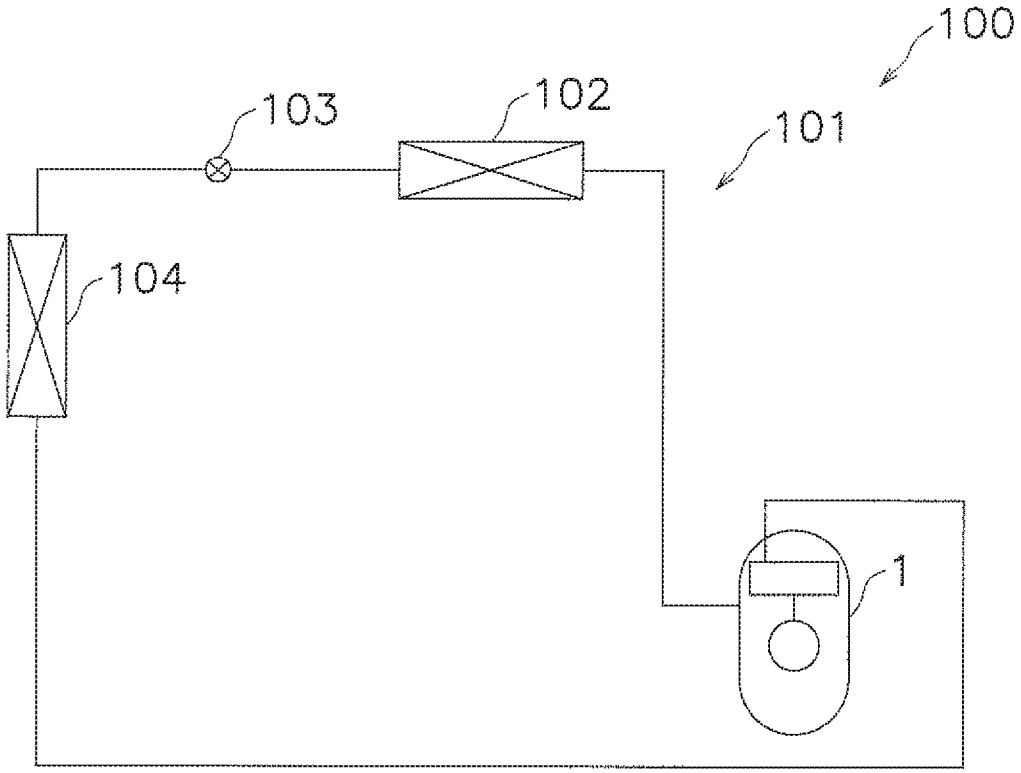
FIG. 11 is a schematic configuration diagram of an air conditioning apparatus that employs the scroll compressor according to the present invention.

The above-mentioned scroll compressor 1 is employed in an air conditioning apparatus 100 that includes a refrigerant circuit 101 shown in FIG. 11. Here, the refrigerant circuit 101 is configured by sequentially connecting the scroll compressor 1 for compressing a refrigerant, a radiator 102 for dissipating heat from the refrigerant, an expansion mechanism 103 for decompressing the refrigerant, and an evaporator 104 for evaporating the refrigerant. The refrigerant circuit 101 is filled with the refrigerant containing R32.

Because of this, since the refrigerant containing R32, in which the temperature of a discharge refrigerant gas tends to increase, is used, the tooth thicknesses tr and ts of the wraps 32 and 42 of the scrolls 30 and 40 are more likely to increase due to the thermal expansion of the wraps. In addition, an increase in each of the tooth thicknesses tr and ts of the wraps 32 and 42 in the scrolls 30 and 40 due to the thermal expansion tends to become more remarkable at the parts near the inner peripheries of the wraps 32 and 42 than at the parts near the outer peripheries of the wraps.

From this fact, here, the scroll compressor 1 employs the scroll structure arranged in consideration of the thermal expansion of the scrolls 30 and 40 during operation, so that a side clearance δ at the part near the inner periphery of each of the wraps 32 and 42 is less likely to become extremely small, and that a side clearance δ at the part near the outer periphery of each of the wraps 32 and 42 is less likely to become extremely large during the operation. Thus, the friction loss and leakage loss of the refrigerant in the scroll compressor 1 can be reduced, which contributes to improvement of an air conditioning capability of the air conditioning apparatus 100.

(3) Modified Example

In the above-mentioned embodiments, the increase in the side clearance δ can be obtained by decreasing the tooth thicknesses ts and tr of the fixed-side wrap 32 and the movable-side wrap 42 from the outer peripheral side to the inner peripheral side in consideration of the thermal expansion of the scrolls 30 and 40 during the operation. However, the configuration of the scroll compressor is not limited thereto. Alternatively, the increase in the side clearance δ may be obtained by decreasing only the tooth thickness ts of the fixed-side wrap 32 from the outer peripheral side to the inner peripheral side, or by decreasing only the tooth thickness tr of the movable-side wrap 42 from the outer peripheral side to the inner peripheral side.

INDUSTRIAL APPLICABILITY

The present invention can be widely applied to scroll compressors and air conditioning apparatuses including the same.

What is claimed is:

1. A scroll compressor, comprising:

a fixed scroll having a spiral fixed-side wrap positioned upright on a surface of a fixed-side plate; and a movable scroll orbitably disposed to face the fixed scroll, the movable scroll having a spiral movable-side wrap positioned upright on a surface of a movable-side plate, the movable-side wrap being configured to mesh with the fixed-side wrap, a side clearance being formed between a side surface of the fixed-side wrap and a side surface of the movable-side wrap so as to increase from an outermost peripheral side toward an innermost peripheral side of each of the wraps along the entire length of each of the wraps, the side clearance being a clearance formed between a side surface of the fixed-side wrap and a side surface of the movable-side wrap in a state where the side surface of the fixed-side wrap and the side surface of the movable-side wrap are located closest to each other.

2. The scroll compressor according to claim 1, wherein the increase in the side clearance is set such that the side clearance approaches a uniform state from the outer peripheral side to the inner peripheral side during an orbiting operation of the movable scroll.

3. The scroll compressor according to claim 1, wherein the increase in the side clearance is set such that an increase rate of the side clearance becomes larger from the outer peripheral side toward the inner peripheral side.

4. The scroll compressor according to claim 1, wherein the increase in the side clearance is obtained by decreasing a tooth thickness of at least one of the fixed-side wrap and the movable-side wrap from the outer peripheral side toward the inner peripheral side.

5. The scroll compressor according to claim 1, wherein a refrigerant containing R32 is compressed.

6. An air conditioning apparatus including the scroll compressor according to claim 1.

7. The scroll compressor according to claim 2, wherein the increase in the side clearance is set such that an increase rate of the side clearance becomes larger from the outer peripheral side toward the inner peripheral side.

8. The scroll compressor according to claim 2, wherein the increase in the side clearance is obtained by decreasing a tooth thickness of at least one of the fixed-side wrap and the movable-side wrap from the outer peripheral side toward the inner peripheral side.

9. The scroll compressor according to claim 2, wherein a refrigerant containing R32 is compressed.

10. An air conditioning apparatus including the scroll compressor according to claim 2.

11. The scroll compressor according to claim 3, wherein the increase in the side clearance is obtained by decreasing a tooth thickness of at least one of the fixed-side wrap and the movable-side wrap from the outer peripheral side toward the inner peripheral side.

12. The scroll compressor according to claim 3, wherein a refrigerant containing R32 is compressed.

13. An air conditioning apparatus including the scroll compressor according to claim 3.

14. The scroll compressor according to claim 4, wherein a refrigerant containing R32 is compressed.

15. An air conditioning apparatus including the scroll compressor according to claim 4.

16. An air conditioning apparatus including the scroll compressor according to claim 5.

* * * * *